US005813957A

United States Patent [19]

Rossiter

[11] Patent Number: 5,813,957

[45] Date of Patent: Sep. 29, 1998

[54] AQUATIC ABDOMINAL EXERCISER APPARATUS

[76] Inventor: Frank E. Rossiter, 208 National Union Blvd., Tuckerton, N.J. 08087

[21] Appl. No.: 842,217

[22] Filed: Apr. 24, 1997

[51] Int. Cl.[6] ..... A63B 23/02

[52] U.S. Cl. ..... 482/140; 482/111; 482/132; 482/142; 441/129

[58] Field of Search ..... 482/55, 92, 93, 482/95, 96, 111, 112, 131–134, 139, 140, 142, 148, 907, 908; 601/23, 33; D21/237, 191; 4/573.1, 575.1, 578.1, 579; 434/254; 441/35, 60, 127, 129, 131

[56] References Cited

U.S. PATENT DOCUMENTS

| | | | |
|---|---|---|---|
| D. 385,930 | 11/1997 | Chen | D21/191 |
| 2,577,129 | 12/1951 | Johnston et al. | 601/136 |
| 3,102,280 | 9/1963 | Williams | 441/130 |
| 3,879,033 | 4/1975 | Martin | 482/142 |
| 5,106,078 | 4/1992 | Rowe | 482/92 |
| 5,290,209 | 3/1994 | Wilkinson | 482/96 |
| 5,514,057 | 5/1996 | Ciolino | 482/111 |
| 5,577,987 | 11/1996 | Brown | 482/132 |
| 5,630,778 | 5/1997 | Barreca | 482/132 |
| 5,697,874 | 12/1997 | Abelbeck | 482/132 |
| 5,725,463 | 3/1998 | Colonello et al. | 482/908 |

*Primary Examiner*—Jeanne M. Clark

[57] ABSTRACT

A aquatic abdominal exerciser apparatus including an exerciser frame having a pair of side bars each having a central linear extent having a top end and a bottom end. Further provided is at least one arcuate extent integrally coupled to each central linear extent. The exerciser frame also has an adjustable crossbar coupled between the linear extents adjacent the bottom ends thereof. Lastly, a support frame is pivotally coupled to the exerciser frame thereby allowing the exerciser frame to pivot about an axis defined by the cross bar. The support frame is, in turn, fixedly coupled to a bath tub thus allowing use of the exerciser frame therein.

10 Claims, 3 Drawing Sheets

AQUATIC ABDOMINAL EXERCISER APPARATUS

BACKGROUND OF THE INVENTION

1. Field of the Invention

The present invention relates to a aquatic abdominal exerciser apparatus and more particularly pertains to performing abdominal exercises under water.

2. Description of the Prior Art

The use of exercisers is known in the prior art. More specifically, exercisers heretofore devised and utilized for the purpose of working various muscle groups are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,368,537 to Felice; U.S. Pat. No. 5,033,742 to Johnson et al.; U.S. Pat. No. Des. 348,491 to Diep; U.S. Pat. No. 5,224,914 to Friedman; U.S. Pat. No. 5,100,130 to Shoebrooks; and U.S. Pat. No. 4,603,858 to Reehil.

In this respect, the aquatic abdominal exerciser apparatus according to the present invention substantially departs from the conventional concepts and designs of the prior art, and in so doing provides an apparatus primarily developed for the purpose of performing abdominal exercises under water.

Therefore, it can be appreciated that there exists a continuing need for a new and improved aquatic abdominal exerciser apparatus which can be used for performing abdominal exercises under water. In this regard, the present invention substantially fulfills this need.

SUMMARY OF THE INVENTION

In view of the foregoing disadvantages inherent in the known types of exercisers now present in the prior art, the present invention provides an improved aquatic abdominal exerciser apparatus. As such, the general purpose of the present invention, which will be described subsequently in greater detail, is to provide a new and improved aquatic abdominal exerciser apparatus which has all the advantages of the prior art and none of the disadvantages.

To attain this, the present invention essentially comprises an exerciser frame having a pair of side bars each having a central linear extent. Each central linear extent has a top end and a bottom end. The frame further includes a bottom arcuate U-shaped extent having a first end integrally coupled to the bottom end of the associated linear extent and a second end curved upwardly to define a first radius of curvature. Associated therewith is a top arcuate U-shaped extent having a first end integrally coupled to the top end of the associated linear extent and a second end curved upwardly to define a second radius of curvature. Such second radius of curvature is less than the first radius of curvature. As shown in FIGS. 1 & 2, the exerciser frame further has a first cross bar integrally coupled between the second ends of the top arcuate extents of the side bars. A second cross bar is integrally coupled between the top ends of the linear extents of the side bars. A third hollow crossbar is coupled between the linear extents adjacent the bottom ends thereof. The exerciser frame further includes a pair of separate handles integrally coupled in coaxial relationship with each other and in perpendicular relationship with the second ends of the bottom arcuate U-shaped extents. Also included is a plurality of pads each having a generally cylindrical configuration. Such pads are adapted to float and include a first pad situated about the first cross-bar. A pair of second pads are situated about the top arcuate U-shaped extents. A pair of third pads are situated about the linear extents between the third cross bar and the bottom ends of the linear extents. A pair of fourth pads are situated about the bottom arcuate U-shaped extents. Finally, situated about the handles of the exerciser frame is a pair of fifth pads. Also included is a padded head rest having a rectangular configuration with a bottom surface thereof coupled to the second cross bar. As best shown in FIG. 1, the head rest resides within a plane defined by the linear extents of the side bars of the exerciser frame. As shown in FIGS. 1 & 2, a support frame is included having a pair of linear side extents each with a front end and a rear end. A connector bar with an arcuate cross-section is integrally connected between the rear end of each of the side extents. As best shown in FIG. 2, a pair of bath tub engagement portions are provided. Each of such bath tub engagement portions include a vertical post integrally coupled to a central portion of the associated side extent, a horizontal arm integrally coupled at a top end of each vertical post and extended outwardly therefrom, and a downwardly extending containment portion integrally coupled to an outer end of only one of the horizontal arms. By this structure, an inverted U-shaped hook is defined for releasably coupling with a side wall of a bath tub. The third cross bar is releasably and pivotally coupled between the front ends of the side extents thereby allowing the exerciser frame to pivot about an axis defined by the third cross bar. As such, the bath tub may be filled with water and the user may perform abdominal exercises with the benefit of the friction and comfort afforded by the water. Also included is an air cylinder having a first end pivotally coupled to the second cross bar of the exerciser frame and a second end pivotally coupled to the connector bar of the support frame. During use, the air cylinder is adapted to afford a predetermined amount of resistance to the relative movement of the support frame and exercise frame. With reference now to FIGS. 3 & 4, a floating support is provided having a rectangular configuration with a short front portion, a short rear portion, and a pair of long side portions integrally coupled therebetween for defining a hollow interior. The floating support further includes a first set of parallel spaced straps perpendicularly coupled to a bottom surface of the side portions adjacent the front portion of the floating support. Associated therewith is a second set of parallel spaced straps perpendicularly coupled to the bottom surface of the side portions adjacent the rear portion of the floating support. A back rest pad having a rectangular configuration has a rear face coupled to the second set of straps. Finally, a pair of retaining brackets are each situated on opposite interior faces of the side portions. The retaining brackets are adapted to releasably receive ends of the third cross-bar therein thereby allowing the exerciser frame to pivot with respect to the floating support upon the floatation thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved aquatic abdominal exerciser apparatus which has all the advantages of the prior art exercisers and none of the disadvantages.

It is another object of the present invention to provide a new and improved aquatic abdominal exerciser apparatus which may be easily and efficiently manufactured and marketed.

It is a further object of the present invention to provide a new and improved aquatic abdominal exerciser apparatus which is of a durable and reliable construction.

An even further object of the present invention is to provide a new and improved aquatic abdominal exerciser apparatus which is susceptible of a low cost of manufacture with regard to both materials and labor, and which accordingly is then susceptible of low prices of sale to the consuming public, thereby making such aquatic abdominal exerciser apparatus economically available to the buying public.

Still yet another object of the present invention is to provide a new and improved aquatic abdominal exerciser apparatus which provides in the apparatuses and methods of the prior art some of the advantages thereof, while simultaneously overcoming some of the disadvantages normally associated therewith.

Still another object of the present invention is to perform abdominal exercises under water.

Lastly, it is an object of the present invention to provide a new and improved aquatic abdominal exerciser apparatus including an exerciser frame having a pair of side bars each having a central linear extent having a top end and a bottom end. Further provided is at least one arcuate extent integrally coupled to each central linear extent. The exerciser frame also has a crossbar coupled between the linear extents adjacent the bottom ends thereof. Lastly, a support frame is pivotally coupled to the exerciser frame thereby allowing the exerciser frame to pivot about an axis defined by the cross bar. The support frame is in turn fixedly coupled to a bath tub thus allowing use of the exerciser frame therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
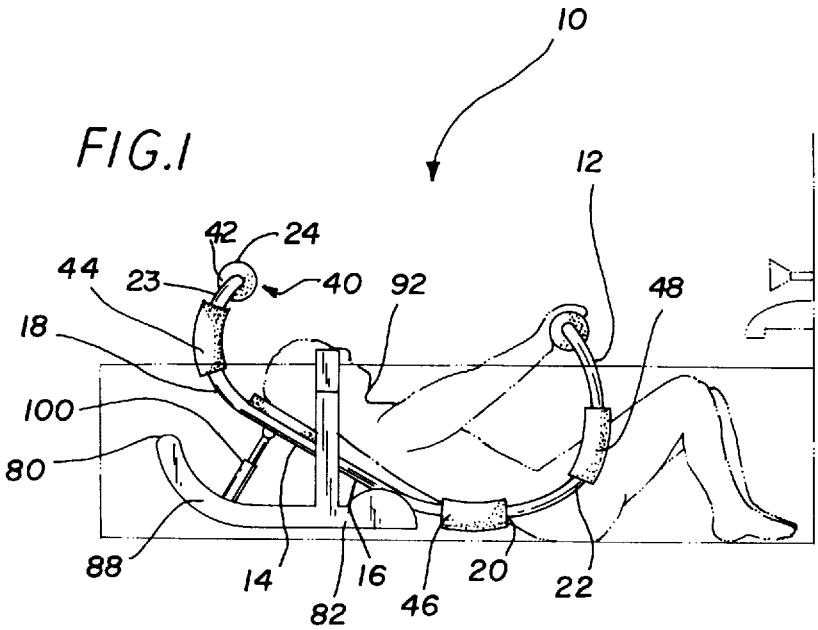
FIG. 1 is an illustration of the preferred embodiment of the aquatic abdominal exerciser apparatus constructed in accordance with the principles of the present invention.

With reference now to the drawings, and in particular to FIG. 1 thereof, a new and improved aquatic abdominal exerciser apparatus embodying the principles and concepts of the present invention and generally designated by the reference numeral 10 will be described.

The present invention, the new and improved aquatic abdominal exerciser apparatus, is comprised of a plurality of components. Such components in their broadest context include a frame exerciser and a floating support. Such components are individually configured and correlated with respect to each other so as to attain the desired objective.

Figure 2:
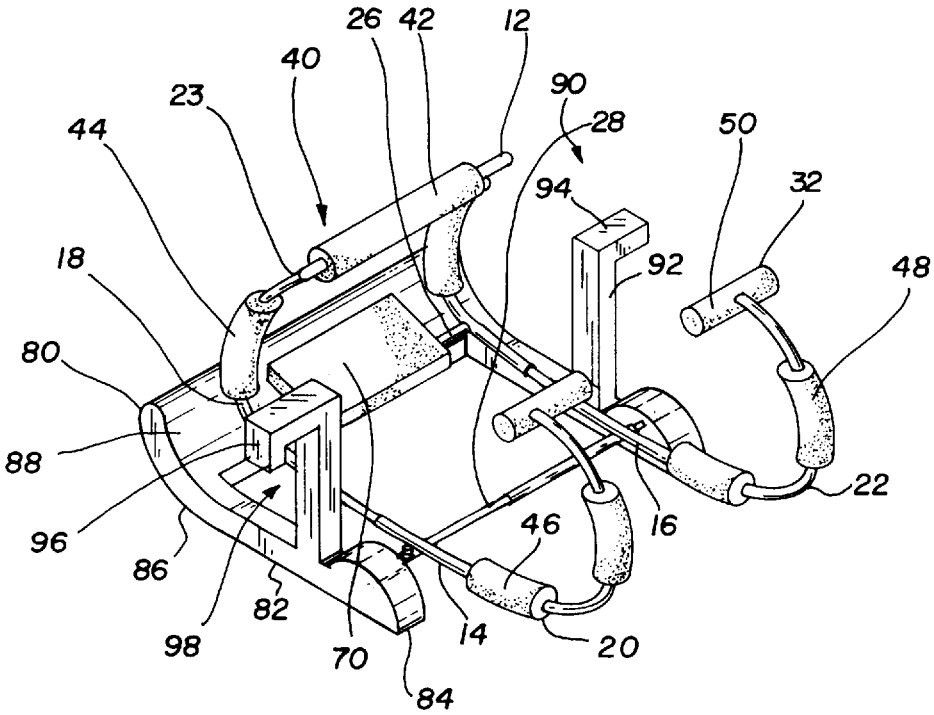
FIG. 2 is a perspective view of the exerciser of the present invention.

More specifically, it will be noted that the system 10 of the present invention includes an exerciser frame 12 having a pair of side bars 14 each having a central linear extent 16. Each central linear extent has a top end 18 and a bottom end 20. Each side bar further includes a bottom arcuate U-shaped extent 22 having a first end integrally coupled to the bottom end of the associated linear extent and a second end curved upwardly to define a first radius of curvature. Associated therewith is a top arcuate U-shaped extent 23 having a first end integrally coupled to the top end of the associated linear extent and a second end curved upwardly to define a second radius of curvature. Such second radius of curvature is less than the first radius of curvature. It should be noted that the linear and arcuate extents of each side bar reside in a similar plane. As an option, the linear extents may be telescoping in nature, thereby allowing the selective adjustment of the length of the exerciser frame. As shown in FIGS. 1 & 2, the exerciser frame further has a first cross bar 24 integrally coupled between the second ends of the top arcuate extents of the side bars. A second cross bar 26 is integrally coupled between the top ends of the linear extents of the side bars. A third hollow crossbar 28 is coupled between the linear extents adjacent the bottom ends thereof. Preferably, the third hollow crossbar is situated a distance from the top ends of the linear extents of the side bars that is greater than ½ the total length of the linear extents. The exerciser frame further includes a pair of separate handles 32 integrally coupled in coaxial relationship with each other and in perpendicular relationship with the second ends of the bottom arcuate U-shaped extents. Such handles extend inwardly a first predetermined distance and extend outwardly a second predetermined distance that is half that of the first predetermined distance.

Also included is a plurality of pads 40 each having a generally cylindrical configuration. Such pads are adapted to float and include a first pad 42 situated about the entire first cross-bar. A pair of second pads 44 are situated about the top arcuate U-shaped extents. A pair of third pads 46 are situated about the linear extents between the third cross bar and the bottom ends of the linear extents. A pair of fourth pads 48 are situated about the bottom arcuate U-shaped extents. Finally, situated about the handles of the exerciser frame is a pair of fifth pads 50. It should be noted that the pads significantly increases the buoyancy of the exercise device. Further, in the preferred embodiment, the pads are constructed from styrofoam.

Also included is a padded head rest 70 having a rectangular configuration with a bottom surface thereof coupled to the second cross bar. As best shown in FIG. 1, the head rest resides within a plane defined by the linear extents of the side bars of the exerciser frame.

As shown in FIGS. 1 & 2, a support frame 80 is included having a pair of linear side extents 82 each with a front end 84 and a rear end 86. A connector bar 88 with an arcuate cross-section is integrally connected between the rear end of each of the side extents. As best shown in FIG. 2, a pair of bath tub engagement portions 90 are provided. Each of such bath tub engagement portions includes a vertical post 92 integrally coupled to a central portion of the associated side extent, a horizontal arm 94 integrally coupled at a top end of each vertical post and extended outwardly therefrom, and a downwardly extending containment portion 96 integrally coupled to an outer end of only one of the horizontal arms. By this structure, an inverted U-shaped hook 98 is defined for releasably coupling with a side wall of a bath tub. It should be noted that the horizontal arm of the other bath tub engagement portion is not equipped with a downwardly extending containment portion so as to allow use with tubs that are positioned against a wall. The height of the vertical post is preferably such that the side extents reside above the bottom of the tub when in use. The third cross bar of the exerciser frame is releasably and pivotally coupled between the front ends of the side extents thereby allowing the exerciser frame to pivot about an axis defined by the third cross bar. Such coupling is afforded by means of a pair of pins extending inwardly from the support frame. These pins are adapted to be received by the third cross bar. It should be noted that all of the cross bars are laterally telescoping to afford lateral adjustability which, in turn, facilitates the coupling with the support frame. Such will be described in greater detail hereinafter. Further, a standard set screw may be utilized to lock the relative position of the telescoping cross bars. For providing strength to such pivotal coupling, the front end of the side extents have semicircular portions integrally coupled thereto and extended upwardly therefrom. As such, the bath tub may be filled with water and the user may perform abdominal exercises with the benefit of the friction and comfort afforded by the water.

Figure 5:
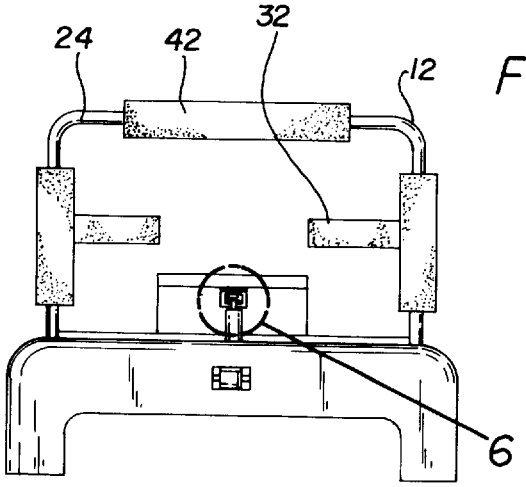
FIG. 5 is a bottom view of the preferred embodiment of the present invention.
Figure 6:
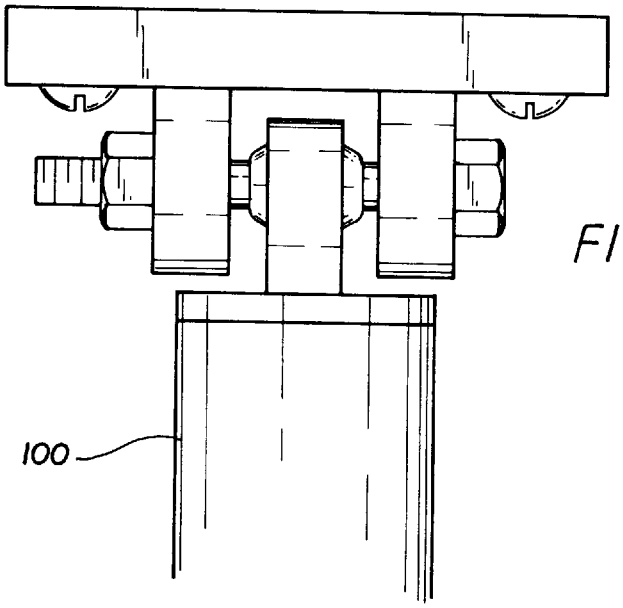
FIG. 6 is a close up view of encircled area 6 shown in FIG. 5.

Also included is an air cylinder 100 having a first end pivotally coupled to the second cross bar of the exerciser frame and a second end pivotally coupled to the connector bar of the support frame. Note FIGS. 5 & 6. During use, the air cylinder is adapted to afford a predetermined amount of resistance to the relative movement of the support frame and exercise frame.

In an unillustrated alternate embodiment, a pair of suction support members are included in lieu of the support frame and air cylinder. Each suction support member is equipped with a post having a first end slidably coupled within ends of the third cross bar. Each post further has a suction cup rotatably coupled to a second end thereof for releasably coupling with side walls of the bath tub. The suction cup and third cross bar thus allow the exerciser frame to pivot within the bath tub about an axis defined by the third cross bar. To fixedly engage the post with respect to the third cross bar and the exerciser frame, a set screw is screwably coupled within a threaded aperture formed in the third cross bar for engaging the post of the corresponding suction support member.

Figure 3:
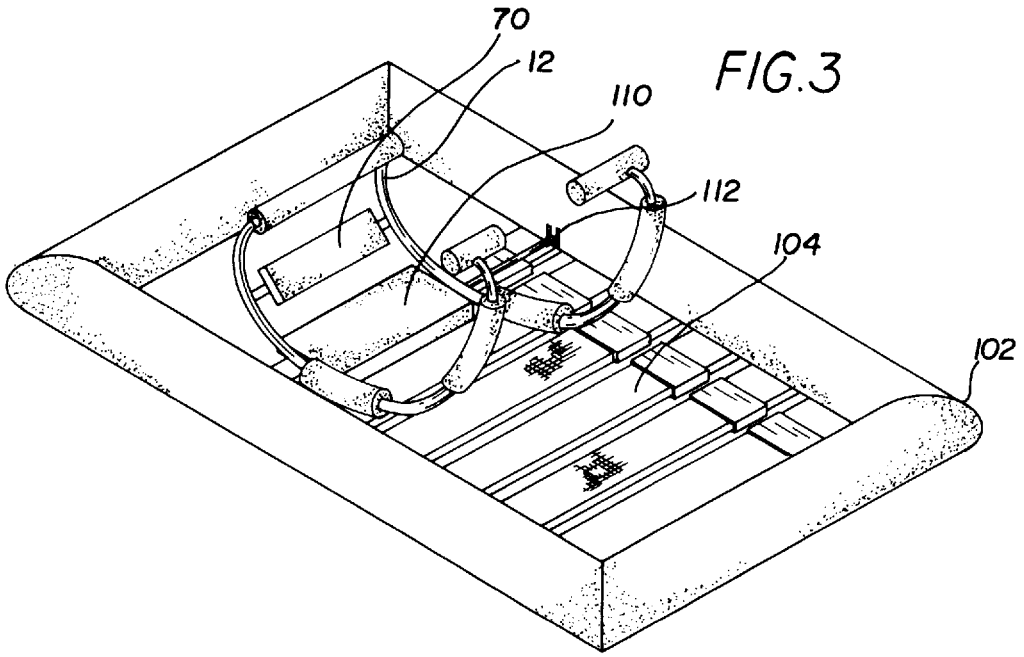
FIG. 3 is a perspective view of the exerciser and the floating support of the present invention in an operative orientation.
Figure 4:
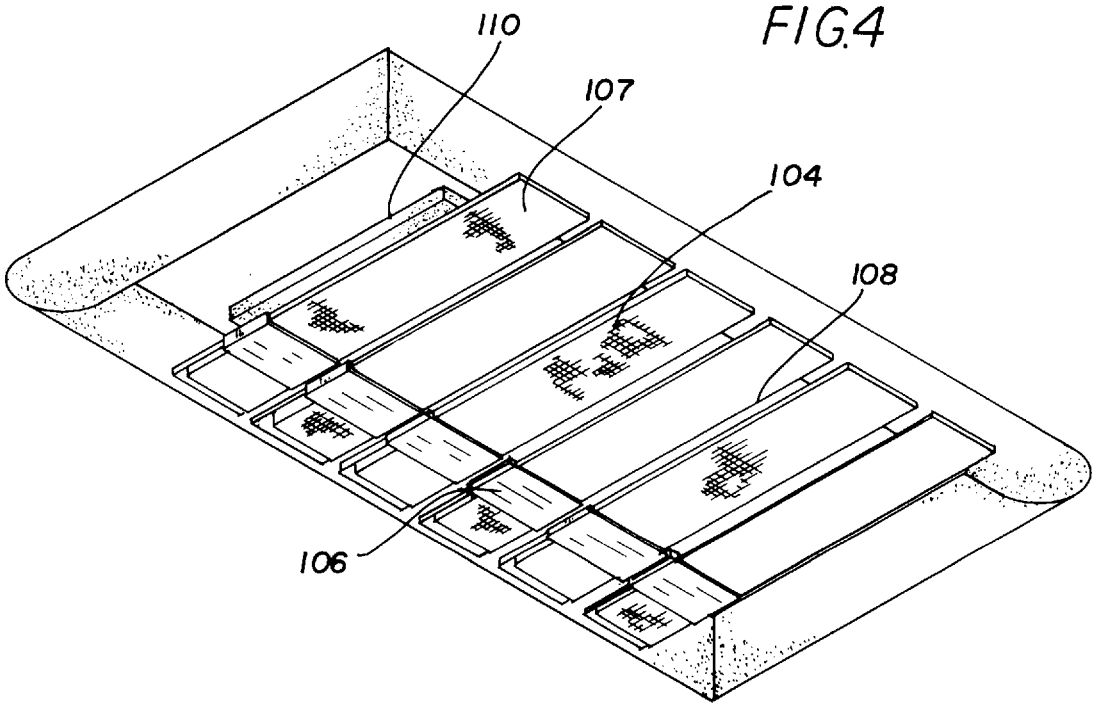
FIG. 4 is a bottom perspective view of the floating support of the present invention.

With reference now to FIGS. 3 & 4, a floating support 102 is provided having a rectangular configuration with a short front portion, a short rear portion, and a pair of long side portions integrally coupled therebetween for defining a hollow interior. The floating support is preferably constructed from styrofoam and has a circular cross-section. The floating support further includes a first set of parallel spaced straps 104 perpendicularly coupled to a bottom surface of the side portions adjacent the front portion of the floating support. Each of such straps have strap adjustment members 106 coupled thereto for adjusting the tightness thereof. Further included is a second set of parallel spaced straps 108 perpendicularly coupled to the bottom surface of the side portions adjacent the rear portion of the floating support. A back rest pad 110 having a rectangular configuration has a rear face coupled to the second set of straps. Finally, a pair of retaining brackets 112 are each situated on opposite interior faces of the side portions. The retaining brackets are adapted to releasably receive ends of the third cross-bar therein thereby allowing the exerciser frame to pivot with respect to the floating support upon the floatation thereof. As shown in FIG. 4, the retaining brackets include a hollow square box with an open top and a slot formed on an interior face thereof for receiving the third cross-bar. By this structure, a user may rest upon the straps and perform abdominal exercises in a body of water.

It should be noted that it is the lateral adjustability of the exerciser device which allows the dual use of the frame of the present invention with both the floating support and support frame. Since a majority of bath tubs are narrow in design, the side bars of the excerciser frame may be situated close to each other for proper use therein. When the exerciser frame is employed in combination with the floating support, the side bars may be separated by a greater distance thus rendering more comfortable use therewith. Further, such lateral adjustability may render maximum separation of the side bars when the excerciser frame is used on dry land without the floating support and support frame.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved aquatic abdominal exerciser apparatus comprising, in combination:

an exerciser frame having a pair of side bars each having a central linear extent having a top end and a bottom end, a pair of bottom arcuate U-shaped extent having a first end integrally coupled to the bottom end of the associated linear extent and a second end curved upwardly to define a first radius of pair of top arcuate U-shaped extent having a first end integrally coupled to the top end of the associated linear extent and a second end curved upwardly to define a second radius of curvature less than the first radius of curvature, the exerciser frame further having a first cross bar integrally coupled between the second ends of the top arcuate extents of the side bars, a second cross bar integrally coupled between the top ends of the linear extents of the side bars, and a third hollow crossbar coupled between the linear extents adjacent the bottom ends thereof, the exerciser frame further including a pair of separate handles integrally coupled in coaxial relationship with each other and in perpendicular relationship with the second ends of the bottom arcuate U-shaped extent;

a plurality of pads each having a generally cylindrical configuration including a first pad situated about the first cross-bar, a pair of second pads situated about the top arcuate U-shaped extents, a pair of third pads situated about the linear extents between the third cross bar and the bottom ends of the linear extents, a pair of fourth pads situated about the bottom arcuate U-shaped extents, and a pair of fifth pad situated about the handles of the exerciser frame;

a padded head rest having a rectangular configuration with a bottom surface thereof coupled to the second cross bar and residing within a plane defined by the linear extents of the side bars of the exerciser frame;

a support frame having a pair of linear side extents each with a front end and a rear end, a connector bar with an arcuate cross-section integrally connected between the rear end of each of the side extents and a pair of bath tub engagement portions including a vertical post integrally coupled to a central portion of the associated side extent, a horizontal arm integrally coupled at a top end of each vertical post and extended outwardly therefrom, and a downwardly extending containment portion integrally coupled to an outer end of only one of the horizontal arms thereby defining an inverted U-shaped hook for releasably coupling with a side wall of a bath tub, the third cross bar releasably and pivotally coupled between the front ends of the side extents thereby allowing the exerciser frame to pivot about an axis defined by the third cross bar;

an air cylinder having a first end pivotally coupled to the second cross bar of the exerciser frame and a second end pivotally coupled to the connector bar of the support frame, the air cylinder adapted to afford a predetermined amount of resistance to the relative movement of the support frame and exercise frame;

a floating support having a rectangular configuration with a short front portion, a short rear portion, and a pair of long side portions integrally coupled therebetween for defining a hollow interior, the floating support further including a first set of parallel spaced straps perpendicularly coupled to a bottom surface of the side portions adjacent the front portion of the floating support, a second set of parallel spaced straps perpendicularly coupled to the bottom surface of the side portions adjacent the rear portion of the floating support, a back rest pad having a rectangular configuration with a rear face coupled to the second set of straps, and a pair of retaining brackets each situated on opposite interior faces of the side portions, the retaining brackets are adapted to releasably receive ends of the third cross-bar therein thereby allowing the exerciser frame to pivot with respect to the floating support upon the floatation thereof.

2. A aquatic abdominal exerciser apparatus in combination with a bath tub comprising:

an exerciser frame having a pair of side bars each having a central linear extent having a top end and a bottom end and at least one arcuate extent integrally coupled to each central linear extent, the exerciser frame having a crossbar coupled between the linear extents adjacent the bottom ends thereof; and a support means pivotally coupled to the exerciser frame thereby allowing the exerciser frame to pivot about an axis defined by the cross bar wherein the support means includes a support frame having means for fixedly coupling to the bath tub thus allowing use of the exerciser frame therein;

whereby the excerciser frame is utilized in water within the bath tub.

3. A aquatic abdominal exerciser apparatus as set forth in claim 2 wherein the support frame has a pair of linear side extents each with a front end and a rear end, a connector bar integrally connected between the rear end of each of the side extents and a pair of bath tub engagement portions including a vertical post integrally coupled to a central portion of the associated side extent, a horizontal arm integrally coupled at a top end of each vertical post and extended outwardly therefrom, and a downwardly extending containment portion integrally coupled to an outer end of only one of the horizontal arms thereby defining an inverted U-shaped hook for releasably coupling.

4. A aquatic abdominal exerciser apparatus as set forth in claim 2 wherein the support means also includes a floating support with a short front portion, a short rear portion, and a pair of side portions integrally coupled therebetween for defining a hollow interior, the floating support further adapted for allowing the coupling of the cross bar thereto for allowing the exerciser frame to pivot with respect to the floating support upon the floatation thereof.

5. A aquatic abdominal exerciser apparatus as set forth in claim 4 and further including a set of parallel spaced straps perpendicularly coupled to the side portions of the floating support.

6. A aquatic abdominal exerciser apparatus as set forth in claim 5 and further including a back rest pad coupled to the set of straps.

7. A aquatic abdominal exerciser apparatus as set forth in claim 2 and further including a plurality of pads each having a generally cylindrical configuration.

8. A aquatic abdominal exerciser apparatus as set forth in claim 7 wherein the pads are made of buoyant material.

9. A aquatic abdominal exerciser apparatus as set forth in claim 2 and further including a padded head rest having a rectangular configuration with a bottom surface thereof coupled to a second cross bar that is integrally coupled between the top ends of the linear extents of the side bars.

10. A aquatic abdominal exerciser apparatus as set forth in claim 2 and further including an air cylinder having a first end coupled to the exerciser frame and a second end coupled to the support means, the air cylinder adapted to afford a predetermined amount of resistance to the relative movement of the support means and exercise frame.

* * * * *